United States Patent [19]

Zachariassen

[11] 3,959,938

[45] June 1, 1976

[54] WALL SYSTEM OF CORRUGATED SECTIONS

[76] Inventor: John Zachariassen, 30 Krogshojvej, DK-2880 Bagsvaerd, Copenhagen, Denmark

[22] Filed: June 26, 1974

[21] Appl. No.: 483,443

[30] Foreign Application Priority Data

July 2, 1973 United Kingdom ..... 31395/73

[52] U.S. Cl. ..... 52/293; 52/294; 52/537; 52/630; 61/39; 61/49; 61/59

[51] Int. Cl.[2] ..... E02D 27/30; E04C 2/32

[58] Field of Search ..... 52/169, 293, 294, 537, 52/630; 61/39, 49, 58, 59

[56] References Cited

UNITED STATES PATENTS

| | | | |
|---|---|---|---|
| 2,054,679 | 9/1936 | Nelson | 52/293 X |
| 2,249,818 | 7/1941 | Gifford | 61/60 |
| 2,888,818 | 6/1959 | Leuthesser | 52/169 X |
| 3,195,312 | 7/1965 | Rumsey, Jr. | 52/293 X |
| 3,224,205 | 12/1965 | Greiner et al. | 52/537 X |
| 3,226,935 | 1/1966 | Schneller | 52/294 X |
| 3,229,468 | 1/1966 | Schneller | 51/59 X |
| 3,316,721 | 5/1967 | Heilig | 61/39 |
| 3,492,826 | 2/1970 | Horstketter et al. | 61/58 X |
| 3,747,353 | 7/1973 | Monahan | 61/39 |
| 3,818,658 | 6/1974 | Slaven | 52/169 |

FOREIGN PATENTS OR APPLICATIONS

| | | | |
|---|---|---|---|
| 1,811,682 | 6/1970 | Germany | 52/169 |
| 1,130,148 | 5/1922 | Germany | 52/293 |
| 327,347 | 10/1920 | Germany | 52/169 |

*Primary Examiner*—Ernest R. Purser
*Assistant Examiner*—Leslie A. Braun
*Attorney, Agent, or Firm*—Cushman, Darby & Cushman

[57] ABSTRACT

A corrugated wall system formed of prefabricated individual wall sections. Each individual section comprises a member - formed of reinforced concrete or the like — having front and rear portions spaced by a dimension of corrugation. Both the thicknesses of the front and rear portions, and the dimension of corrugation increase as one moves from the top or a wall section to the bottom thereof. The wall sections are embedded in an in-situ cast foundation in side-to-side relationship at the bottoms thereof.

7 Claims, 7 Drawing Figures

WALL SYSTEM OF CORRUGATED SECTIONS

BACKGROUND AND SUMMARY OF THE INVENTION

Walls subject to horizontal loads such as water and earth pressure, wind etc. are traditionally constructed from plain or reinforced concrete cast in-situ or from steel sheet piles (see U.S. Pat. Nos. 3,316,721 and 3,492,826 for exemplary prior art structures).

The utilization of the materials in such structures is generally poor. Nevertheless, the economy of these traditional structures in many cases still compete favourably with more recent structures made from prefabricated reinforced concrete elements, chiefly, because the designs of prefabricated elements for walls generally are following the same basic shape of conventional in-situ cast walls — with the corresponding consequence of uneconomical use of the materials.

Retaining walls are also known to have been made in reinforced concrete as folded plate structures approximately corresponding to walls made from sheet piles of the Larssen type. However, folded plate reinforced concrete structures of the said type have a number of drawbacks, the most important of which are the following:

1. The cross section and thus the effective depth is the same in all horizontal sections of the wall, although the requirement usually is an increasing effective depth corresponding to an increasing distance from the top of the wall.

2. The area of the concrete is the same in all horizontal sections of the wall, although the forces acting on the concrete are increasing gradually corresponding to the increasing distance from the top of the wall.

3. Different heights of walls require different sizes of folded plates, each size of which requires separate sets and size of moulds.

Accordingly, the disadvantages of the prior art are overcome by the present invention, through which novel methods are presented for producing retaining and other walls of different heights using a minimum of materials and using the same mould for these different heights of walls.

With this invention, a wall structure is provided having corrugations oscillating along a preselected axis line for the wall structure. While the corrugations at the top of walls according to the invention all are of identical size, the depth of the corrugations are increasing gradually towards the bottom of the wall. Also, the thickness of the front and the rear parts of the corrugations are increasing gradually towards the bottom of the wall.

In this way, the effective depth as well as the effective and structurally useful area of horizontal cross sections of a wall are increasing towards the bottom of the wall as is consequently the moment of inertia, which is a basic factor for the strength in any section of the wall.

Since the forces acting on the wall normally are increasing gradually towards the bottom of the wall, and since the materials are the better utilized, the more they are placed in the zones of maximum forces, the basic geometric shape as described above will represent a considerable saving in materials compared with a conventionally shaped, in-situ cast or prefabricated wall.

The basic corrugations of the wall may thus be sinuous, trapezoid and have any other basic shape, which form corrugations when linked together in a continuous band.

In spite of the varying cross sections of the wall, the basic geometry as described above may allow the front surface and the rear surface of the wall to be congruent or near-congruent. This feature greatly facilitates the production of the wall, especially when it is made from prefabricated sections, in the case of which the sections may be stacked as an integral part of the production process (as described in my copending U.S. application Ser. No. 483,444 filed June 26, 1974. Thus the handling and the transport of the wall elements are also made easier and more economical through the congruency of the surfaces.

BRIEF DESCRIPTION OF THE DRAWING

For further illustration of the invention, an example is given in the following, in which the wall system is made from prefabricated reinforced concrete elements.

DETAILED DESCRIPTION OF THE DRAWINGS

The wall elements as shown in the ajoining drawings no. 1, 2 and 3 may be placed directly on a supporting platform. In this way initial stability is established directly through forces of gravity and friction. Furthermore, stability may be increased through burying the lower part of the wall in the ground. In case of retaining walls, the normal way of securing the stability would be to line up the wall elements (see FIG. 1), 1, on a binding layer, 5, and thereafter cast in situ a foundation, 6, around the bottom part of the wall elements.

Figures 1, 2, 3:
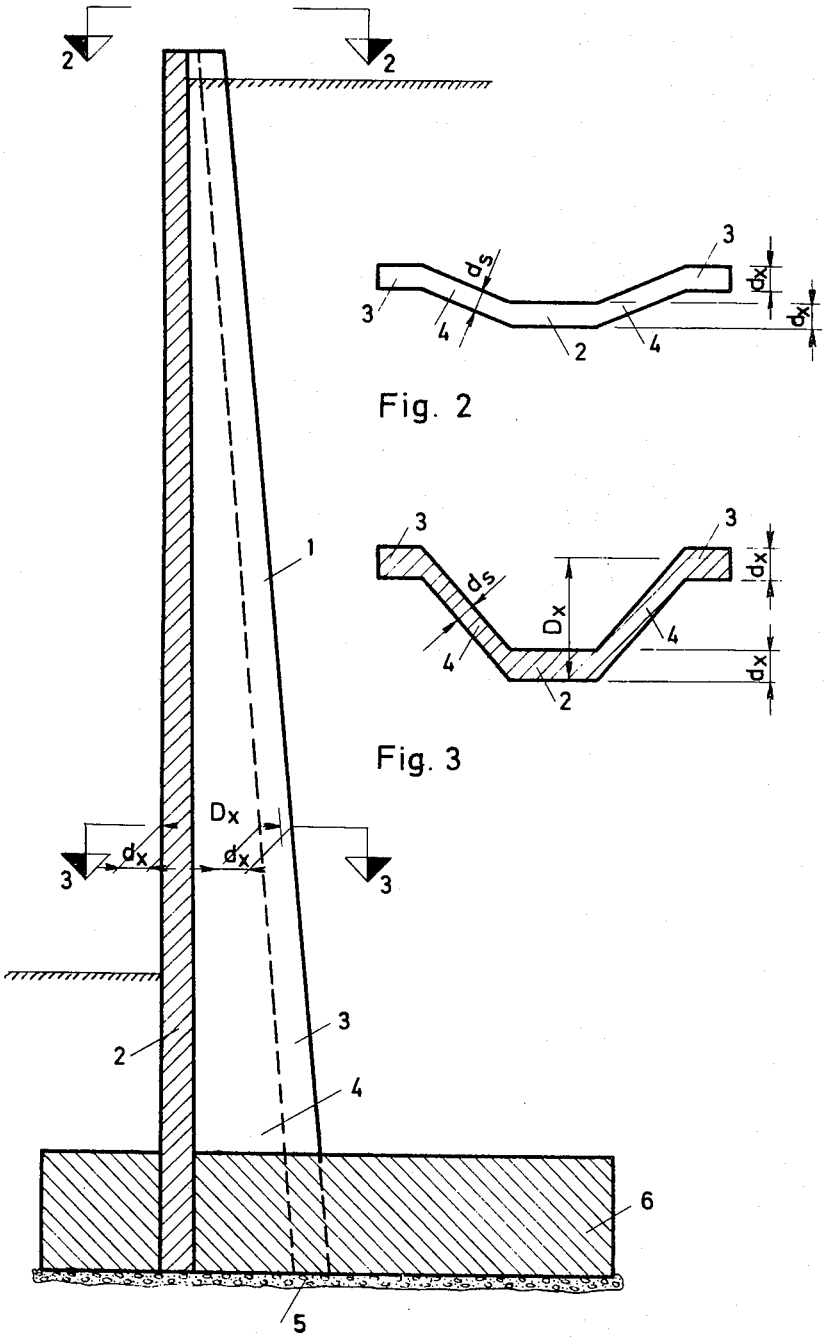
FIG. 1 is a side view partly in cross-section of an exemplary wall assembly according to the present invention.
FIG. 2 is a top plan view taken along lines 2—2 of FIG. 1.
FIG. 3 is a cross-sectional view taken along lines 3—3 of FIG. 1.

As can be seen from a comparison of FIGS. 2 and 3 the corrugation at the top of the elements is considerably lower than at the bottom of the elements, the corrugations and thus the effective depth, $D_x$, being increased gradually downwards in the elements. Correspondingly, the thickness, $d_x$, of the material in the front and the rear of the sections increase gradually downwards in the elements to take up the increasing compressive and eventual tensile forces. In this way it is possible to optimize the combination of reinforcement and matrix material. (such as steel and concrete respectively).

The thickness, $d_s$, of the connecting parts, 4, (FIGS. 1–3) may simultaneously be kept constant throughout the length of the elements. This may facilitate the placing of eventual spacers in these parts of the elements.

The geometric shape of the connecting parts may be hyperbolic-paraboloid as are those shown, 4, in FIGS. 1–3. This shape is especially suitable for the transfer of forces into and between the front and the rear parts of the wall at the same time as it allows a constant thickness of the connecting parts even though the front part and the rear part have increasing thickness towards the bottom of the elements.

Main reinforcement is placed in the front and the rear parts of the elements. The special shape of the elements with increasing corrugations towards the bottom makes possible the economic use of the same cross section of the steel in the top as in the bottom of the element. Also elements of different total length will thus have the same dimensions of reinforcement, thus making possible a very rational production of reinforcing nets.

Figure 4:
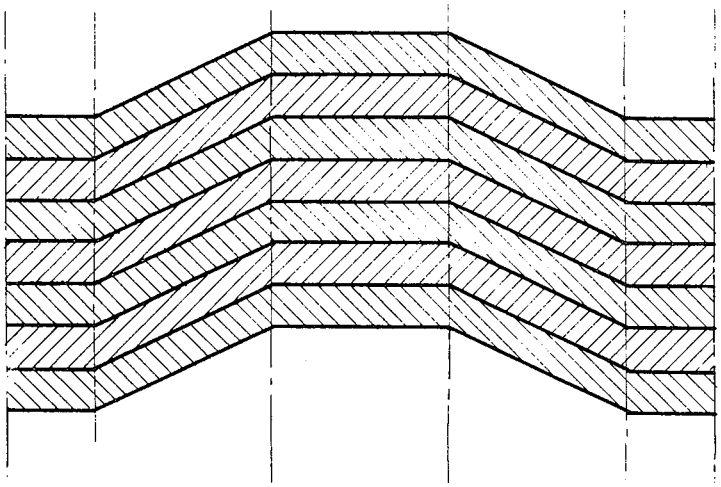
FIG. 4 is a horizontal cross-sectional view taken along the top of a plurality of pile elements cast in a pile arrangement.
Figure 5:
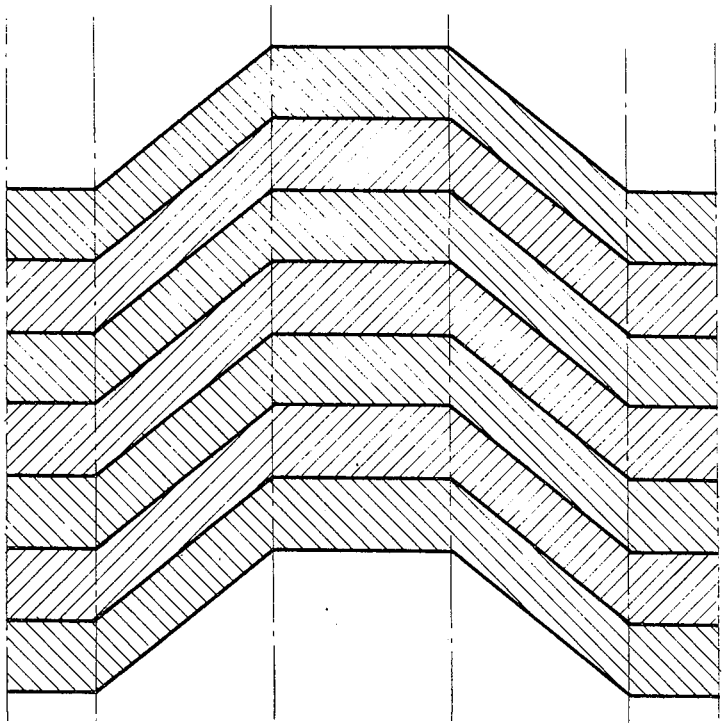
FIG. 5 is a horizontal cross-sectional view taken along the bottom of a plurality of pile elements cast in a pile arrangement.

Eventual reinforcement in the foundation, 6, (FIG. 1) may be placed through holes or notches not shown in the bottom part of the wall elements. The shape of the elements with congruent front and rear surfaces make possible the production of the elements directly side by side or on top of each other (battery or pile casting); FIGS. 4 and 5 show the tops and bottoms respectively of elements cast in such a manner.

The top parts of all elements are identical. That is, a short element is identical with the top end of a longer element. The geometry mentioned facilitates the manufacturing process and makes possible the manufacturing of elements of different lengths and strengths in one and the same mould.

In the above description is mentioned steel reinforced concrete. However, other materials may be used with similar advantage such as magnesia, gypsum, alumina cement and other hydraulic binders as well as plastic materials. As reinforcement may be used steel bars or fibres or a combination of both.

The joints between the elements may be detailed according to requirements, i.e. made water-proof, semi closed, open or adjustable.

The system may also include standard graphs and tables from which can be taken directly the width and the reinforcement of the necessary foundation in case the height of the wall, the loads and the earth constants are known.

The system may be used for large dams as well as for small regulations of terrain in build up areas. It may be used for loads from one side and from both sides. It may be used for storage of bulk materials and liquids. Also it may be used as wind and sound screens.

Figure 6:
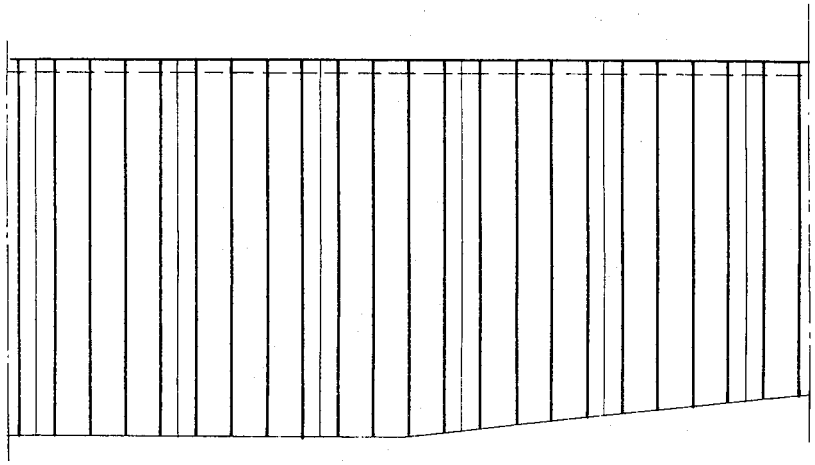
FIG. 6 is an elevation of a wall assembled according to the present invention with a sloping lower level.
Figure 7:
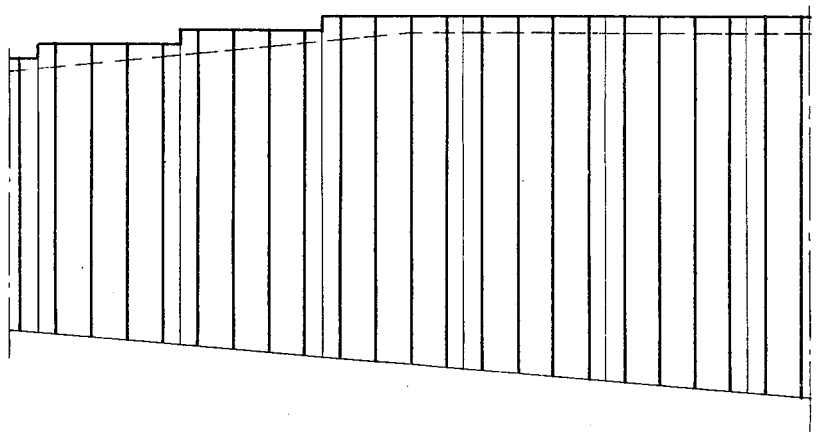
FIG. 7 is an elevation of a wall assembled according to the present invention with a sloping upper level.

Compared to a traditional reinforced concrete retaining wall, the saving in concrete is about two thirds and the saving in steel is about one half. Only one size of moulds is necessary for many different heights of wall. Stacked casting is possible thus leading to inexpensive production and transpot in case of making prefabricated elements according to the system. The small corrugations in the top of the wall means small corrugations in low walls, which is an aestetic advantage. Walls with continuously varying heights can favourably be made with the system. FIG. 6 shows a wall constructed according to the invention with a sloping lower level, while FIG. 7 shows a wall with a sloping upper level.

Corrugated wall elements with congruent or near-congruent surfaces may be used as moulds for the casting of further elements. This method may reduce the cost of producing wall elements according to the system.

What is claimed as the invention is:

1. A corrugated wall system composed of prefabricated wall sections, each wall section having two distinct front portions and a rear portion, said front and rear portions spaced from each other by the dimension of corrugation of said wall section, and a connecting portion extending between each of said front portions and said rear portion, wherein the thickness of said front and rear portions increase from the top of each wall section to the bottom of the wall section while the thickness of said connecting portions is substantially constant from the top of each wall section to the bottom thereof, and wherein the dimension of corrugation increases from the top of each wall section to the bottom of the wall section.

2. A corrugated wall system as recited in claim 1 wherein said front and rear portions of each wall section are plane, and wherein said connecting portions are hyperbolic-parabolic shells.

3. A wall system as recited in claim 1 wherein a plurality of wall sections are embedded in an in-situ cast foundation to form the wall system.

4. A wall system as recited in claim 1 wherein wall sections of different height are adapted to be cast from the same mould.

5. A wall system as recited in claim 1 wherein individual wall sections are adapted to be stacked one on top of the other during manufacture thereof.

6. A wall system as recited in claim 1 wherein said individual wall sections are adapted to be used as part of a mould during manufacture of further individual wall sections.

7. A wall system as recited in claim 1 wherein said individual wall sections are formed of reinforced concrete.

* * * * *